US006872156B2

(12) United States Patent
Ogawa et al.

(10) Patent No.: US 6,872,156 B2
(45) Date of Patent: Mar. 29, 2005

(54) BASEBALL OR SOFTBALL BAT, BAT BASE MEMBER AND ELASTIC SLEEVE

(75) Inventors: Masao Ogawa, Osaka (JP); Kazuya Ishida, Osaka (JP); Toshiaki Kida, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/131,762

(22) Filed: Apr. 24, 2002

(65) Prior Publication Data

US 2003/0004020 A1 Jan. 2, 2003

(30) Foreign Application Priority Data

May 2, 2001 (JP) ..... 2001-135294
Apr. 3, 2002 (JP) ..... 2002-101547

(51) Int. Cl.[7] ..... A63B 59/06
(52) U.S. Cl. ..... 473/567
(58) Field of Search ..... 473/519, 520, 473/457, 564–568

(56) References Cited

U.S. PATENT DOCUMENTS 1,325,813 A * 12/1919 Taylor ..... 473/564
2,099,521 A * 11/1937 Herkimer et al. ..... 473/568
4,343,467 A * 8/1982 Newcomb et al. ..... 473/567
4,705,273 A 11/1987 Ament et al.
5,451,047 A * 9/1995 Liu ..... 473/564
5,695,419 A * 12/1997 Haringa ..... 473/564
5,833,561 A * 11/1998 Kennedy et al. ..... 473/564
6,287,221 B1 * 9/2001 Pino ..... 473/564
6,440,017 B1 * 8/2002 Anderson ..... 473/566
2002/0016230 A1 * 2/2002 Okuyama ..... 473/564

FOREIGN PATENT DOCUMENTS

| | | | |
|---|---|---|---|
| JP | 12-2843 | | 3/1937 |
| JP | 51-13165 | * | 4/1976 |
| JP | 57-6668 | | 1/1982 |
| JP | 62-106784 | A | 5/1987 |
| JP | 63-156667 | U | 10/1988 |
| JP | 07-275413 | | 10/1995 |
| JP | 7-275413 | A | 10/1995 |
| JP | 2000005359 | | 1/2000 |
| JP | 2000-153013 | A | 6/2000 |
| JP | 2001-054605 | | 2/2001 |

OTHER PUBLICATIONS

May 27, 2003 Japanese Office Action with translation.
Dec. 9, 2003 Japanese Notice of Ground of Rejection with translation.
Sep. 9, 2003 Japanese Office Action with translation.

* cited by examiner

*Primary Examiner*—Mark S. Graham
(74) *Attorney, Agent, or Firm*—Troutman Sanders LLP; Gerald R. Boss

(57) ABSTRACT

A ball-hitting portion is integrally coated with an elastic body, and thus a bat with durability that can carry the ball far can be obtained. The baseball or softball bat includes a tip portion, a ball-hitting portion, a tapered portion and a grip portion. A depression in the ball-hitting portion is integrally coated with the elastic body having a high rebound property value as a physical property. Thus, when hitting the ball, the elastic body will be compressed and deform, and energy loss due to the ball deformation will be suppressed. Moreover, the ball is carried additionally with a restoring force of the elastic body. Consequently, the bat has rebound property superior to a conventional one, and can carry the ball farther.

20 Claims, 5 Drawing Sheets

BASEBALL OR SOFTBALL BAT, BAT BASE MEMBER AND ELASTIC SLEEVE

CROSS-REFERENCE TO RELATED APPLICATIONS AND CLAIM OF PRIORITY

This application claims priority from Japanese Patent Application No. 2001-135294, filed 2 May 2001 and Japanese Patent Application No. 2002-101547 filed 3 Apr. 2002.

BACKGROUND OF THE INVENTION

1. Field of the Invention

The present invention relates to improvements in rebound property of a baseball or softball bat.

2. Description of the Background Art

Baseball or softball bats (hereinafter, referred to as a "bat") made of various materials are commercially available. Some are made of wood or metal such as titanium, titanium alloy, aluminum alloy or the like. Others are made of fiber-reinforced plastic in which a matrix resin is impregnated and cured in carbon fiber, glass fiber or the like.

When a bat is structured with only one of those materials, however, it is difficult to change a property value of the bat to a large extent. Therefore, a bat made from a combination of various materials has been developed.

In order to achieve a significant change in a value of rebound property of the bat, a variety of bats coated with an elastic body have been developed. For example, Japanese Patent Laying-Open No. 62-106784 discloses a cushion bat with a shape identical to a conventional one, of which core portion extending to entire length thereof is coated with an elastic body. Japanese Utility Model Laying-Open No. 63-156667 discloses a bat packed with a rubber sponge, having two rubber sponges bonded to a wooden core. In addition, Japanese Patent Laying-Open No. 2000-153013 discloses a baseball bat, in which a circumferential surface of a core member made of light metal pipe is coated with an elastic body except for a grip portion. Further, Japanese Patent Laying-Open No. 7-275413 discloses a ball-game bat, in which a core member made of carbon fiber is coated with a hard urethane layer, and a protection layer composed of glass fiber having a synthetic resin impregnated is provided thereon.

In the bats disclosed in Japanese Patent Laying-Open No. 62-106784, Japanese Utility Model Laying-Open No. 63-156667 and Japanese Patent Laying-Open No. 2000-153013, an object of coating with an elastic body is to obtain a bat capable of lowering the impact and vibration in ball-hitting, and suppressing a hit distance of the ball for safe use. Accordingly, the elastic body is used, having a physical property that will suppress the hit distance. These bats are suited, for example, for a use in a narrow space, hitting table tennis ball, or toss batting. Moreover, an object of Japanese Patent Laying-Open No. 7-275413 is to reduce manufacturing cost as well as to improve manufacturing process and a method of adjusting weight and "crack" in hitting the ball. Therefore, appearance and rebound property are not changed at all, compared with a conventional bat.

On the other hand, a baseball or softball bat is required to have durability and a property to carry the ball far. The conventional bat as described above is not satisfactory for such requirements.

SUMMARY OF THE INVENTION

An object of the present invention is to provide a bat having good durability and capable of carrying a ball farther, a bat base member forming such a bat as well as an elastic sleeve.

Inventor has made various attempts and finally implemented a bat structure capable of carrying the ball far. The inventor has found that a high rebound property value of the bat is effective for increasing hit distance of the ball, and that, for improving the rebound property value, it is effective to reduce deformation of the ball in hitting.

In order to reduce deformation of the ball when it is hit, it is possible, for example, to coat the surface of the bat with an elastic body. For a bat used in a baseball or softball game, however, not only durability and rebound property but also mass and balance are important. If the bat is entirely coated with the elastic body, the mass of the bat will be larger, and it becomes difficult to achieve a design with these properties being well-balanced.

According to the above-described findings of the inventors, a baseball or softball bat according to one aspect of the present invention includes a tip portion, a ball-hitting portion, a tapered portion and a grip portion. The ball-hitting portion has a depression integrally coated with an elastic body that has a physical property to attain a high rebound property value.

Thus, when hitting the ball, the elastic body will be compressed and deform, and energy loss due to the ball deformation can be suppressed. Further, the ball will be carried farther with a restoring force of the elastic body. Consequently, the bat can be obtained, that has a rebound property superior to a conventional one and capable of carrying the ball farther. In other words, presence of the elastic body can reduce the extent of deformation of the ball when it is hit, and the restoring force of the elastic body is additionally made use of. Thus, the bat can carry the ball farther. In particular, even when hitting a soft ball such as a rubber baseball or a rubber softball, rebound property of the bat can be improved.

In addition, since only a portion of the bat, that is, the depression of the ball-hitting portion, is coated with the elastic body, an increase of the mass of the bat can be suppressed, than when it is entirely coated.

In games, a batter releases the bat when he starts running after hitting the ball. If the bat is coated with the elastic body up to the tip portion, the tip portion may soon be damaged by friction with the ground. Meanwhile, the bat according to the present invention can avoid such damage because the elastic body coats only the ball-hitting portion. (When the batter releases the bat after hitting, possibility of breaking the elastic body due to contact with the ground can be lowered.)

The bat according to the present invention can have the tip portion, the ball-hitting portion with the depression, the tapered portion and the grip portion formed with a hard material similar to the conventional bat. Therefore, the bat can have rigidity comparable to the conventional one, and thus the bat is durable.

In addition, in the bat according to the present invention, as vibration in ball-hitting is absorbed by the elastic body, batter's hands will not be benumbed. Moreover, a time period during which the ball is in contact with the ball-hitting portion is extended because the elastic body deforms when hitting. Therefore, a feel that the ball is being on the bat can be obtained, and hitting feel will be improved.

In the baseball or softball bat according to one aspect as described above, in order to avoid fractures at a corner in the bottom portion of the depression due to stress concentration and at a corner in the upper portion thereof due to the impact of the ball, desirably, the depression is formed in the following manner. Namely, it is formed with a ball-hitting center portion having an outer diameter smaller than that of the ball-hitting portion. An outer diameter thereof from an end of a tip portion side of the ball-hitting center portion to the boundary of the tip portion and an outer diameter from an end of a tapered portion side of the ball-hitting center portion to the boundary of the tapered portion are gradually increased.

In addition, in the baseball or softball bat according to one aspect as described above, the depression of the ball-hitting portion may include a center portion bottom wall, distance of which from the central axis of the bat is smaller than that from the central axis to an outermost circumferential portion of the ball-hitting portion; a stepped portion bottom wall, distance of which from the central axis of the bat is larger than that from the central axis to the center portion bottom wall and is smaller than that from the central axis to the outermost circumferential portion of the ball-hitting portion, and positioned at both ends of the center portion bottom wall in a direction along the central axis, and extending in a direction substantially the same as the central axis; and a sidewall connecting the center portion bottom wall with the stepped portion bottom wall. The sidewall may be inclined relative to the central axis.

When the stepped portion bottom wall is formed in an end portion of the depression, it appears that a convex portion is formed on the sidewall thereof. Accordingly, contact area of the wall surface of the depression with the elastic body can be made larger. Thus, when hitting the ball at the above-described end portion of the elastic body, separation will be unlikely, and a bat with good durability can be obtained.

In the baseball or softball bat according to one aspect as described above, the ball-hitting portion may include an outermost circumferential portion positioned in a region outside the depression and having a largest outer diameter; a small outer diameter portion provided as a wall surface of the depression and having an outer diameter smaller than that of the outermost circumferential portion; and a medium outer diameter portion provided as a wall surface of the depression, extending in a direction substantially the same with the central axis of the baseball or softball bat, positioned at an end portion of the depression and having an outer diameter larger than that of the small outer diameter portion and smaller than that of the outermost circumferential portion.

In the baseball or softball bat according to one aspect as described above, preferably, the elastic body is of a synthetic resin foam having JIS C hardness of 20 to 80, specific gravity of 0.25 to 0.70 and tensile stress (tensile strength) of 1.0 MPa to 4.0 MPa in 300% elongation. More preferably, the elastic body has JIS C hardness of 20 to 50, specific gravity of 0.25 to 0.50 and tensile stress of 1.0 MPa to 1.8 MPa in 300% elongation. In this case, using what is called a "soft" synthetic resin foam as described above will effectively improve a rebound property value of the bat.

In addition, in the baseball or softball bat according one aspect as described above, the synthetic resin foam preferably uses a polyurethane foam, in view of manufacturing cost and formability. In other words, if what is called the "soft" polyurethane foam is used as the elastic body, the hit distance of the ball can effectively be improved, and an increase of the manufacturing cost of the bat can be suppressed.

In general, polyurethane can be categorized into three types: soft, semi-hard and hard. A soft polyurethane foam used as the elastic body in the present invention includes what is classified as soft and semi-hard, not including hard. Here, hard polyurethane is generally elongated a few percent to several tens of percent. Hard polyurethane with such elongation capability is not suitable for the polyurethane foam as the elastic body in the present invention.

The baseball or softball bat according to one aspect as described above may be provided with a protection film formed on an outermost layer of the elastic body.

In such a case, as the protection film can suppress abrasion of the elastic body, durability of the bat can be improved. In particular when a soft synthetic resin foam as described above is used as the elastic body, durability of the bat can effectively be improved by forming the protection film.

In the baseball or softball bat according to one aspect as described above, the protection film may include at least one of a synthetic resin sheet and a synthetic resin tube.

In the baseball or softball bat according to one aspect as described above, preferably, the protection film has a thickness of not smaller than 0.1 mm and not larger than 1.0 mm, and includes a thermoplastic polyurethane.

In this case, workability in forming the protection film and adhesiveness of the elastic body with the same can be effectively improved.

In order to enhance durability of the bat, desirably, a synthetic resin sheet or tube having sufficient abrasion-resistance coats, and is formed on, the outermost layer of the above synthetic resin foam. In addition, considering workability and adhesiveness, desirably, the synthetic resin sheet or tube is a thermoplastic polyurethane sheet or tube having a thickness of 0.1 mm to 1.0 mm.

In this case, durability of the bat can be improved without impairing the property of the elastic body encapsulated inside the depression.

Moreover, the above thermoplastic polyurethane sheet or tube is desirably transparent or translucent. The above sheet is printed on one surface, and is fused and adhered in a tube-like shape to the surface of the elastic body with the printed surface facing inward. Thus, the print can be clearly viewed through the sheet, to enhance the appearance of the bat. Even after a prolonged use of the bat, the print will not separate.

In the baseball or softball bat according to one aspect as described above, preferably, the depression is formed on the entire circumference of the ball-hitting portion.

In such a case, no matter which portion of the entire circumference of the ball-hitting portion a batter may hit the ball, hit distance of the same can be improved.

A bat base member according to another aspect of the present invention constitutes a baseball or softball bat including a tip portion, a ball-hitting portion, a tapered portion and a grip portion. In a region to be the ball-hitting portion, a depression is formed.

Using such a bat base member, the bat according to the present invention can be readily manufactured by integrally coating the depression with the elastic body.

In the bat base member according to another aspect as described above, the region to be the ball-hitting portion may include an outermost circumferential portion positioned in a region outside the depression and having a largest outer diameter; a small outer diameter portion provided as a wall surface of the depression and having an outer diameter smaller than that of the outermost circumferential portion; and a medium outer diameter portion provided as a wall surface of the depression, extending in a direction substantially the same with the central axis of the bat, positioned at an end portion of the depression and having an outer diameter larger than that of the small outer diameter portion and smaller than that of the outermost circumferential portion.

In this case, a region with a small thickness can be formed in an end portion of the elastic body coating the depression. Therefore, a bat can be readily formed, in which the elastic body is unlikely to separate from the bat base member.

An elastic sleeve according to another aspect of the present invention constitutes a baseball or softball bat including a tip portion, a ball-hitting portion, a tapered portion and a grip portion, and is fit into a depression formed in the ball-hitting portion. The elastic sleeve includes a smallest inner diameter portion positioned in a center portion therein and having a smallest inner diameter; and an enlarged inner diameter portion positioned at an end portion thereof, having an inner diameter larger than that of the smallest inner diameter portion and extending in a direction substantially the same with the elastic sleeve.

Using such an elastic sleeve, a bat according to the present invention can readily be manufactured by integrally coating the depression of the ball-hitting portion with the elastic sleeve.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
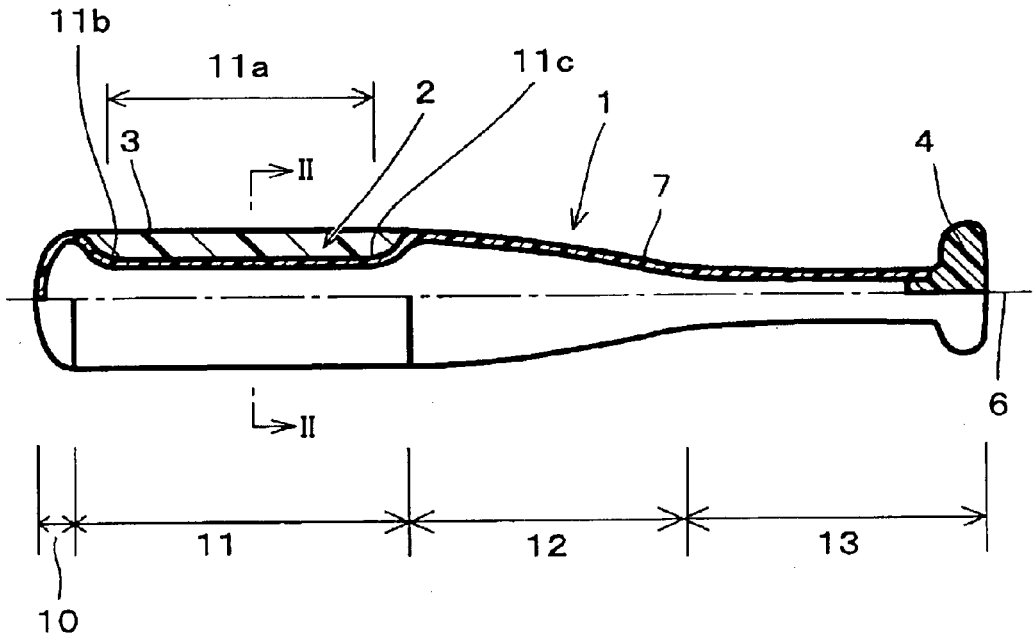
FIG. 1 is a schematic partial cross-sectional side view of a first embodiment of a bat according to the present invention.

In the following, embodiments of the present invention will be described in detail with reference to the figures. It is noted that the same reference characters refer to the same or corresponding components in the figures.

(First Embodiment)

Figure 2:
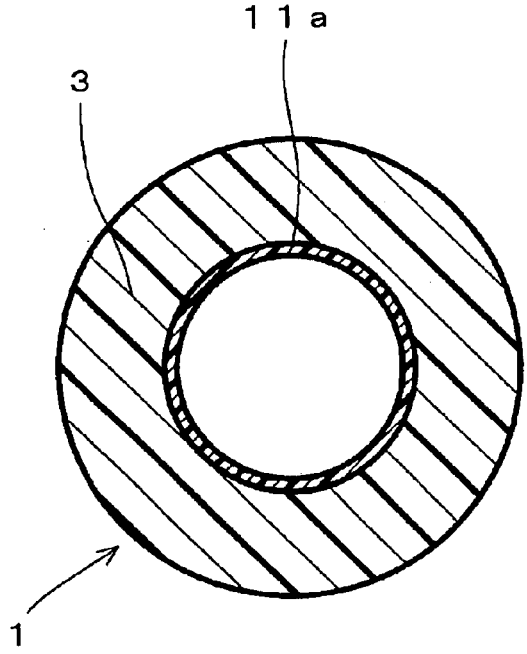
FIG. 2 is a schematic cross-sectional view along the line II—II in FIG. 1.

Referring to FIGS. 1 and 2, a first embodiment of a bat according to the present invention will be described.

A bat according to the present invention has a depression of a ball-hitting portion integrally coated with an elastic body that has a largest rebound property confirmed in various experiments. As shown in FIGS. 1 and 2, a baseball or softball bat 1 includes a tip portion 10, a ball-hitting portion 11, a tapered portion 12 and a grip portion 13. A bat base member 7 constituting bat 1 is provided with a depression 2 in a portion to be ball-hitting portion 11. Desirably, the depression is formed with a ball-hitting center portion 11*a* having an outer diameter smaller than that of ball-hitting portion 11, and an outer diameter thereof from an end 11*b* of a tip portion side of ball-hitting center portion 11*a* to the boundary of tip portion 10 and an outer diameter from an end 11*c* of a tapered portion side of ball-hitting center portion 11*a* to the boundary of tapered portion 12 are gradually increased. Depression 2 formed on the entire circumference of ball-hitting portion 11 is integrally coated with an elastic body 3. Here, depression 2 may be formed partially in a circumferential direction of ball-hitting portion 11. At an end portion of grip portion 13, a grip end 4 is fit in and secured to a bat base member 7.

In such a bat 1 according to the present invention, when hitting the ball, elastic body 3 will be compressed and deform, and energy loss due to the ball deformation can be suppressed. Further, the ball will be carried additionally with a restoring force of elastic body 3. Consequently, bat 1 can be obtained, having a rebound property superior to a conventional one and capable of carrying the ball farther. In particular, even when hitting a soft ball such as a rubber baseball or a rubber softball, rebound property of bat 1 can be improved.

In addition, since only a portion of bat 1, that is, depression 2 of ball-hitting portion 11, is coated with elastic body 3, an increase of the mass of bat 1 can be suppressed, compared with when bat 1 is entirely coated.

In games, a batter releases bat 1 when he starts running after hitting the ball. If bat 1 is coated with the elastic body as far as tip portion 10, the elastic body and the like may soon be damaged by friction of tip portion 10 with the ground. Bat 1 according to the present invention can avoid such damage because elastic body 3 coats only ball-hitting portion 11.

Bat 1 according to the present invention can have tip portion 10, ball-hitting portion 11 with depression 2, tapered portion 12 and grip portion 13 formed with a hard material similar to the conventional one, as described below. Therefore, bat 1 can have rigidity comparable to the conventional one, and thus bat 1 is durable.

In addition, in bat 1 according to the present invention, as vibration in ball-hitting is absorbed by elastic body 3, batter's hands will not be benumbed. Moreover, a time period during which the ball is in contact with ball-hitting portion 11 is extended because elastic body 3 deforms when hitting. Therefore, a feel that the ball is being on bat 1 can be obtained, and hitting feel will be improved.

Moreover, depression 2 is formed on the entire circumference of ball-hitting portion 11. Therefore, with no matter which portion of the entire circumference of ball-hitting portion 11 a batter may hit the ball, hit distance of the same can be improved.

Figure 3:
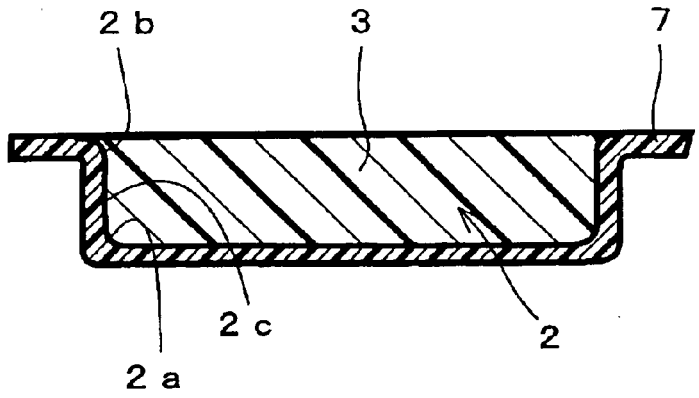
FIG. 3 is a schematic partial cross-section illustrating a first variation of the first embodiment of the bat according to the present invention, shown in FIGS. 1 and 2.

As shown in FIG. 3, a corner 2*a* in a bottom portion and a corner 2*b* in an upper portion of depression 2 may be rounded, and a sidewall 2*c* of depression 2 may be formed perpendicularly to a central axis 6 (see FIG. 1) in a direction of bat length.

The whole bat, having depression 2 formed in ball-hitting portion 11 (bat base member 7), may be formed with any of the conventional materials, such as wood, metal or fiber-reinforced plastic. Tip portion 10 and grip end 4 can be formed integrally with bat base member 7 as a whole bat, or may be formed separately for attachment.

Desirably, elastic body 3 integrally coats depression 2 of ball-hitting portion 11, using injection molding or cast molding of a synthetic resin. Alternatively, elastic body 3 as an elastic sleeve may be formed separately so as to fit with a shape of depression 2 of ball-hitting portion 11 for adhering.

The elastic body 3 may be of a material having a low ratio of energy loss when restituting after elastic deformation, and a material such as ionomer, butadiene-based rubber and the like as well as an air bag can be used. Considering mass, ratio of energy loss, manufacturing cost and formability, a polyurethane foam having JIS C hardness of 20 to 80, specific gravity of 0.25 to 0.70 and tensile stress of 1.0 MPa to 4.0 MPa in 300% elongation is preferred. The range of those figures was determined for a reason as described below. When hardness is set to 20 or lower, it becomes difficult to form a bat. When it is set to 80 or higher, rebound property will not be improved, compared with a conventional bat. Similarly, when specific gravity is set to 0.25 or lower, it becomes difficult to form a bat, and when it is set to 0.70 or higher, rebound property will not be improved, compared with the conventional bat. In addition, when tensile stress in 300% elongation is set to 1.0 MPa or lower, it becomes difficult to form a bat, and when it is set to 4.0 MPa or higher, rebound property will not be improved, compared with the conventional bat.

If priority is given to rebound property, for elastic body 3, a polyurethane foam having JIS C hardness of 20 to 50, specific gravity of 0.25 to 0.50 and tensile stress of 1.0 MPa to 1.8 MPa in 300% elongation is preferred.

Figure 4:
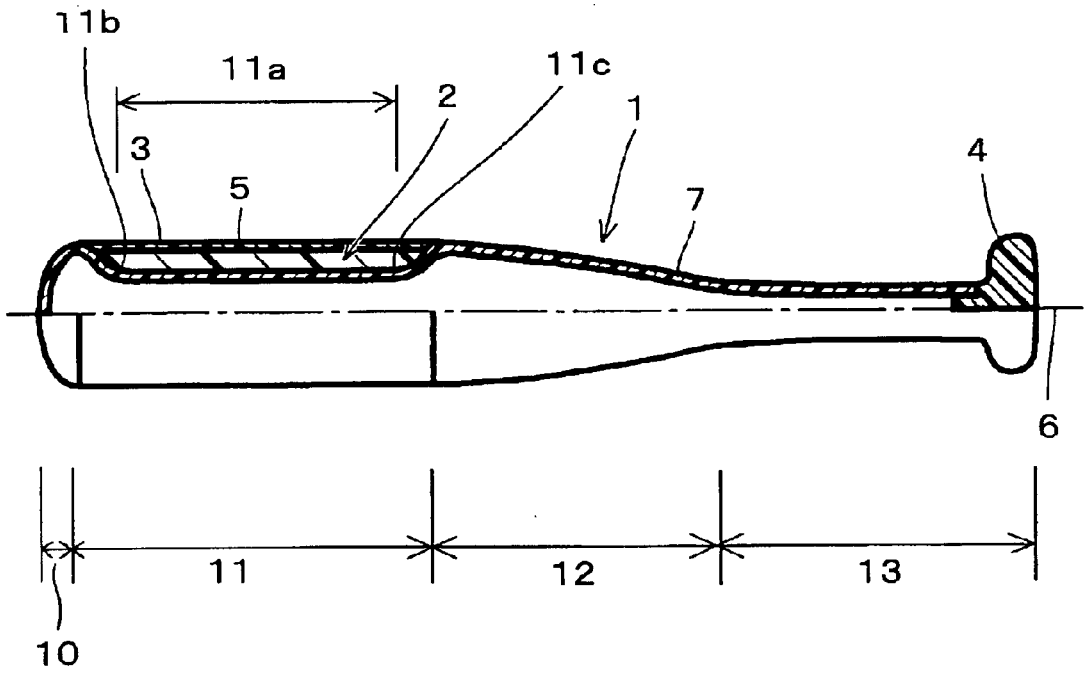
FIG. 4 is a schematic partial cross-sectional side view of a second variation of the first embodiment of the bat according to the present invention.

Referring to FIG. 4, a second variation of the bat will be described. FIG. 4 corresponds to FIG. 1.

As shown in FIG. 4, bat 1 basically has a similar structure to bat 1 shown in FIGS. 1 and 2. On the surface of elastic body 3, however, a sheet 5 as a protection film is formed.

Thus, as sheet 5 provides protection of elastic body 3, durability of bat 1 can be improved. In particular, when a synthetic resin foam is used for elastic body 3, durability of the bat can effectively be improved by arranging such a sheet 5.

For sheet 5 formed and used for integral coating of an outermost layer of elastic body 3 composed of the synthetic resin foam and the like, desirably, a synthetic resin sheet or tube having a good abrasion-resistance is used. Considering workability and adhesiveness, desirably, the synthetic resin sheet or tube is a thermoplastic polyurethane sheet or tube having a thickness of not smaller than 0.1 mm and not larger than 1.0 mm.

Here, if the thickness of the synthetic resin sheet or tube is less than 0.1 mm, strength of the sheet or tube itself is not sufficient, and does not enhance durability. On the other hand, if the thickness exceeds 1.0 mm, sheet 5 itself becomes hard, and may impair property of elastic body 3 encapsulated inside. Desirably, the thermoplastic polyurethane sheet or tube having a JIS A hardness of 80 to 100 and tensile strength of 450 to 500 kg/cm$^2$ is used. If JIS A hardness is less than 80, strength of the sheet or tube itself is not sufficient, and does not enhance durability. On the other hand, if JIS A hardness exceeds 100, sheet 5 itself becomes hard, and may impair the property of elastic body 3 encapsulated inside. The same will also apply to tensile strength.

Moreover, the synthetic resin sheet used for sheet 5 is desirably transparent or translucent. Sheet 5 is printed on one surface, and is fused and adhered in a tube-like shape, with the printed surface facing inward. Then the tube is formed integrally with elastic body 3. Thus, the print can be clearly viewed through the sheet, to enhance the appearance of the bat. Even after a prolonged use of bat 1, the print will not separate.

(Second Embodiment)

Figure 5:
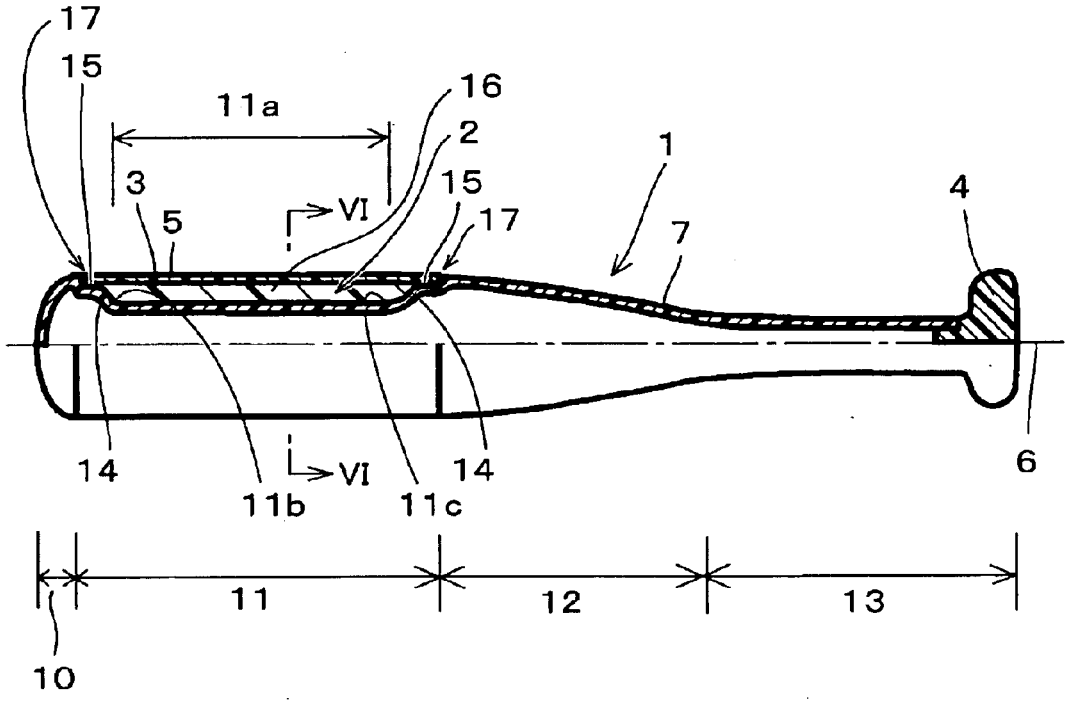
FIG. 5 is a schematic partial cross-sectional side view of a second embodiment of a bat according to the present invention.
Figure 6:
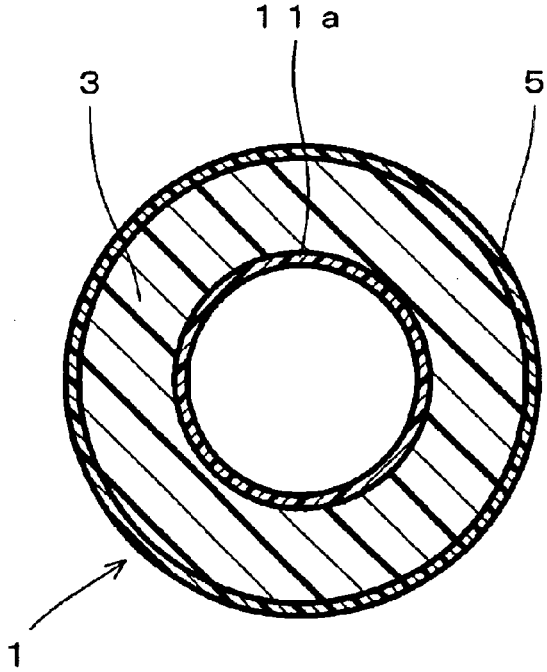
FIG. 6 is a schematic cross-sectional view along the line VI—VI in FIG. 5.
Figure 7:
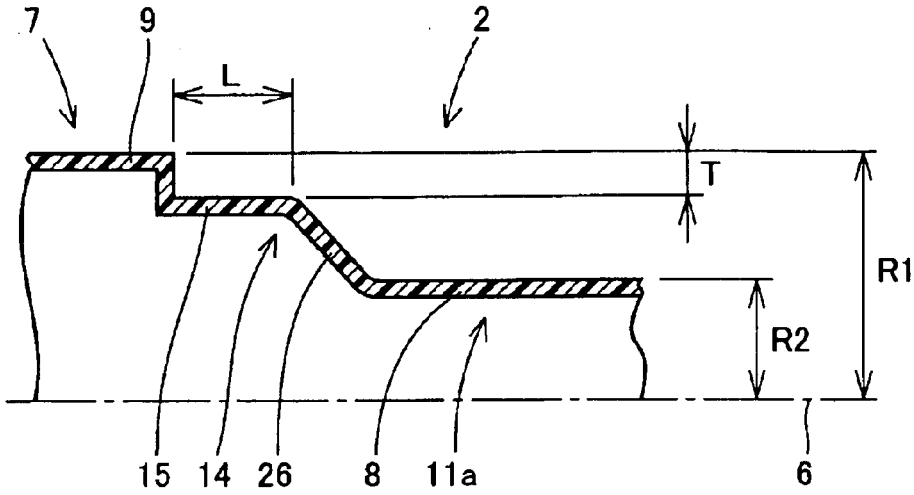
FIG. 7 is a schematic partial cross-section illustrating a depression of the bat shown in FIG. 5.

Referring to FIGS. 5 to 7, a second embodiment of a bat according to the present invention will be described.

As shown in FIGS. 5 to 7, bat 1 basically has the same structure as the one shown in FIG. 4 except for the shape of depression 2. In other words, depression 2 may include a center portion bottom wall 8 as a small outer diameter portion of ball hitting center portion 11*a*, distance of which from central axis 6 of baseball or softball bat 1 is smaller than distance R1 (see FIG. 7) from central axis 6 to an outermost circumferential portion of ball-hitting portion 11; an end portion region 15 as a stepped portion bottom wall (see FIG. 5), distance of which from central axis 6 is larger than distance R2 (see FIG. 7) from central axis 6 to center portion bottom wall 8 of ball-hitting center portion 11*a* and is smaller than distance R1 from central axis 6 to outermost circumferential portion 9 of ball-hitting portion 11, and positioned at both ends of ball-hitting center portion 11*a* in a direction along central axis 6 and extending in a direction substantially the same as central axis 6; and a sidewall 26 connecting ball-hitting center portion 11*a* with end portion region 15 as a medium outer diameter portion. Sidewall 26 is inclined relative to central axis 6.

In this case, in an enlarged inner diameter portion 17 (see FIG. 5), which is an end portion of elastic body 3 (see FIG. 5) as an elastic sleeve positioned on end portion region 15, elastic body 3 has a thickness relatively smaller than in a smallest inner diameter portion 16 (see FIG. 5), which is a center portion of elastic body 3. (Elastic body 3 includes smallest inner diameter portion 16 as well as enlarged inner diameter portion 17 positioned at an end portion of elastic body 3, having an inner diameter larger than that of smallest inner diameter portion 16 and extending in a direction substantially the same as elastic body 3 (a direction in which central axis 6 extends)).

In addition, when end portion region 15 is formed in an end portion of depression 2, it appears that a convex portion (a stepped portion 14, see FIG. 7) is formed on the side surface thereof. Accordingly, contact area of the side surface of depression 2 with elastic body 3 can be made larger. Thus, when hitting the ball at the end portion of elastic body 3, separation of elastic body 3 will be unlikely, and bat 1 with good durability can be obtained.

Depression 2 of bat 1 may specifically be shaped in a following manner. For example, as shown in FIG. 7, assume that distance R1 from central axis 6 of bat 1 to the outermost circumference of ball-hitting portion 11 (see FIG. 5) is set to 34.5 mm and distance R2 from central axis 6 to ball-hitting center portion 11*a* is set to 20 mm. In this example, distance T, which is a depth from the outermost circumferential surface of ball-hitting portion 11 (see FIG. 5) to the surface of end portion region 15, can be set to not smaller than 1.0 mm and not larger than 10.0 mm. Preferably, distance T is set to not smaller than 1.5 mm and not larger than 7.0 mm. More preferably, distance T is set to not smaller than 2.0 mm and not larger than 4.0 mm. If distance T is less than 1.0 mm, the thickness of elastic body 3 (see FIG. 5) arranged on end portion region 15 will be too small. This may cause elastic body 3 to separate or to break easily. On the other hand, if distance T is over 10.0 mm, the body strength of bat base member 7, which is a body of bat 1 (see FIG. 5), may not be sufficient (sufficient strength cannot be achieved).

Width L of end portion region 15 may be set to not smaller than 3.0 mm and not larger than 30.0 mm. In addition, preferably, width L is set to not smaller than 5.0 mm and not larger than 25.0 mm. More preferably, width L is set to not smaller than 10.0 mm and not larger than 20.0 mm. If width L is less than 3.0 mm, contact area of elastic body 3 (see FIG. 5) with end portion region 15 will be too small, resulting in easy separation of elastic body 3 from end portion region 15. If width L is over 30.0 mm, the size of a portion where elastic body 3 of a sufficient thickness is arranged will be smaller in ball-hitting portion 11 (see FIG. 5). That is, the portion capable of maximizing the hit distance of the ball will be made smaller.

The inclination angle of the surface of end portion region 15 relative to central axis 6 of bat 1 (see FIG. 5) can be set to not smaller than −18° and not larger than +18°. Here, inclination angle of −18° means that when a tip portion 10 (see FIG. 5) side of bat 1 in end portion region 15 is inclined toward central axis 6 side, a phantom straight line along the surface of end portion region 15 in FIG. 7 and central axis 6 cross with an angle of 18°. Similarly, inclination angle of +18° means that when a grip portion 13 (see FIG. 5) side of bat 1 in end portion region 15 is inclined toward central axis 6 side, a phantom straight line along the surface of end portion region 15 in FIG. 7 and central axis 6 cross with an angle of 18°. In addition, preferably, the inclination angle is set to not smaller than −12° and not larger than +12°. More preferably, the inclination angle is set to not smaller than −6° and not larger than +6°.

If the inclination angle of end portion region 15 is less than −18° or over +18°, elastic body 3 tends to separate from bat base member 7 (see FIG. 5).

Further, as shown in FIG. 7, sidewall 26 connecting end portion region 15 with center portion bottom wall 8 of ball-hitting center portion 11*a* (a center portion of depression 2) may be inclined relative to central axis 6, or may extend substantially perpendicularly to central axis 6.

Figure 8:
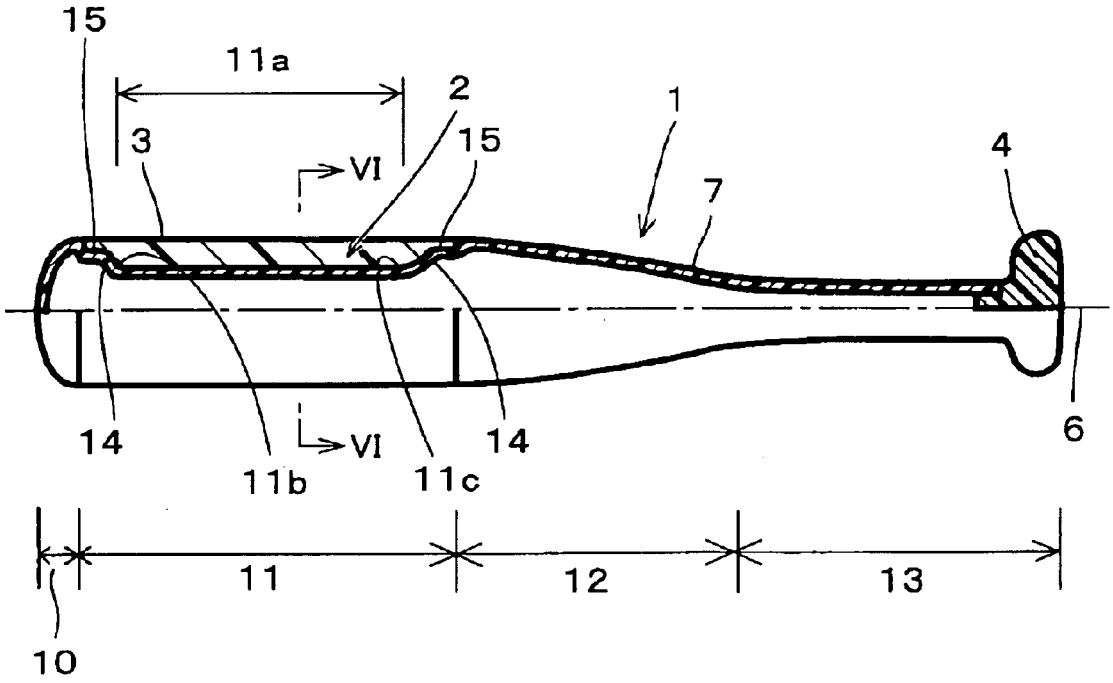
FIG. 8 is a schematic partial cross-sectional side view of a variation of the second embodiment of the bat according to the present invention.

Referring to FIG. 8, a variation of the second embodiment of the bat according to the present invention will be described. FIG. 8 corresponds to FIG. 5.

As shown in FIG. 8, though bat 1 basically has the same structure as the one shown in FIGS. 5 to 7, a sheet 5 (see FIG. 5) is not formed on the surface of elastic body 3 of ball-hitting portion 11. That is, the surface of elastic body 3 is exposed. In this case as well, the same effect as with the bat shown in FIGS. 5 to 7 can be obtained.

In the following, results from two experiments conducted to verify the effect of a polyurethane foam used for a material of elastic body 3 (see FIG. 1) will be discussed.

Figure 9:
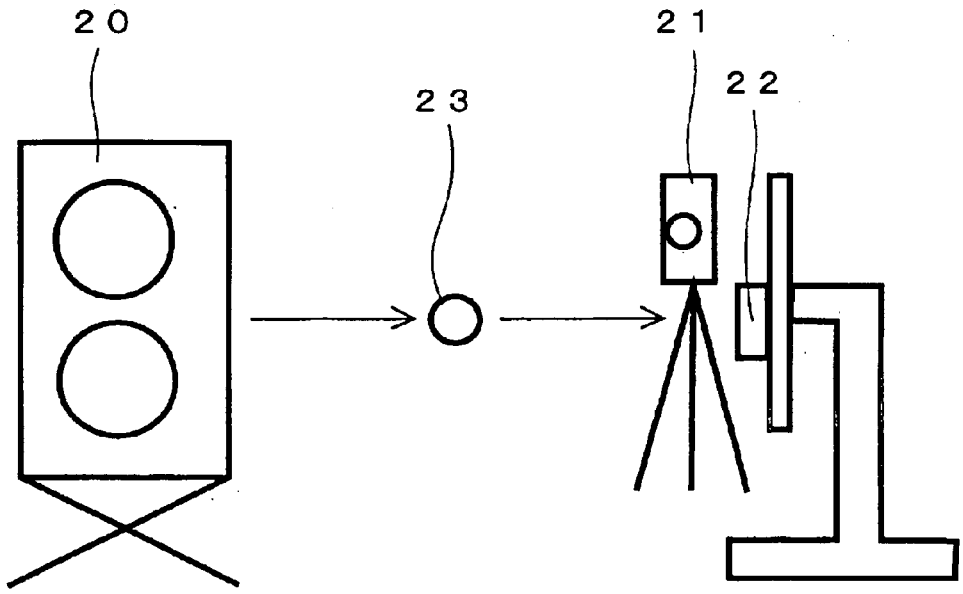
FIG. 9 is a schematic view of an experiment apparatus used for a rebound experiment of a ball-hitting portion model.

First, using an experiment apparatus as shown in FIG. 9, a rebound experiment of a ball-hitting portion model was conducted.

As shown in FIG. 9, the experiment apparatus included a pitching machine 20, a high-speed video camera 21 and an image analyzer (not shown). Two types of ball-hitting portion models 22 as a hit target of a ball 23 were provided. One was of an iron plate only, and the other was prepared by bonding an elastic body to an iron plate. In the experiment, ball 23 was fed from pitching machine 20 to impact fixed ball-hitting portion model 22. High-speed video camera 21 filmed the impact from right beside. Then, restitution coefficient was calculated from the speed of ball 23 before and after the impact.

The elastic body used for the ball-hitting portion model was a polyurethane foam sheet having JIS C hardness of 40 to 80 and specific gravity of 0.35 to 0.66, and was prepared by bonding two square sheets with a side of 10 cm long and a thickness of 10 mm.

The present experiment was conducted using a rubber baseball, the reason for which is as follows. When hitting a rubber baseball or softball, elastic deformation of the ball is too larger and rebound property of the bat cannot fully be taken advantage of. Accordingly, significant difference in rebound property cannot be observed, not matter which bat may be used. Therefore, in order to verify the effect of a structure of the ball-hitting portion capable of improving rebound property of the bat even for such a soft ball, a rubber baseball was used. Thus, though degrees may vary, similar effect can be obtained in both leather baseball and leather softball.

Next, an equation of calculating restitution coefficient e and description of the reference characters are provided in Equation 1. The method of measuring data is also shown below.

$$e = V\cdot\text{BALL (OUT)}/V\cdot\text{BALL (IN)} \qquad \text{[Equation 1]}$$

e: restitution coefficient

V·BALL (OUT): velocity of gravity center of the ball after impact (m/s)

V·BALL (IN): velocity of gravity center of the ball before impact (m/s)

The velocity of gravity center of the ball in the above equation was obtained by analyzing with an image analyzer, an image filmed by the high-speed video camera.

Next, a result of a rebound experiment, in which a rubber baseball impacts each ball-hitting portion model with a speed of 30 m/s, is shown in Table 1 below.

TABLE 1

| | Elastic Body | | | |
|---|---|---|---|---|
| Ball-hitting Portion Model | Hardness | Specific Gravity | Elasticity Modulus (MPa) | Restitution Coefficient |
| Iron Plate only | — | — | — | 0.416 |
| Model 1 | 40 | 0.351 | 1.23 | 0.482 |
| Model 2 | 45 | 0.393 | 1.39 | 0.477 |
| Model 3 | 55 | 0.484 | 2.40 | 0.459 |
| Model 4 | 60 | 0.490 | 2.67 | 0.450 |
| Model 5 | 64 | 0.539 | 2.70 | 0.441 |
| Model 6 | 80 | 0.657 | 3.96 | 0.423 |

Elasticity modulus shows tensile stress in 300% elongation.

As can be seen from the experiment result in Table 1, restitution coefficient is higher in a model having an elastic body bonded than in a model of an iron plate with a flat surface. In addition, as the hardness, specific gravity and elasticity modulus of the elastic body become smaller, the restitution coefficient will be larger.

Figure 10:
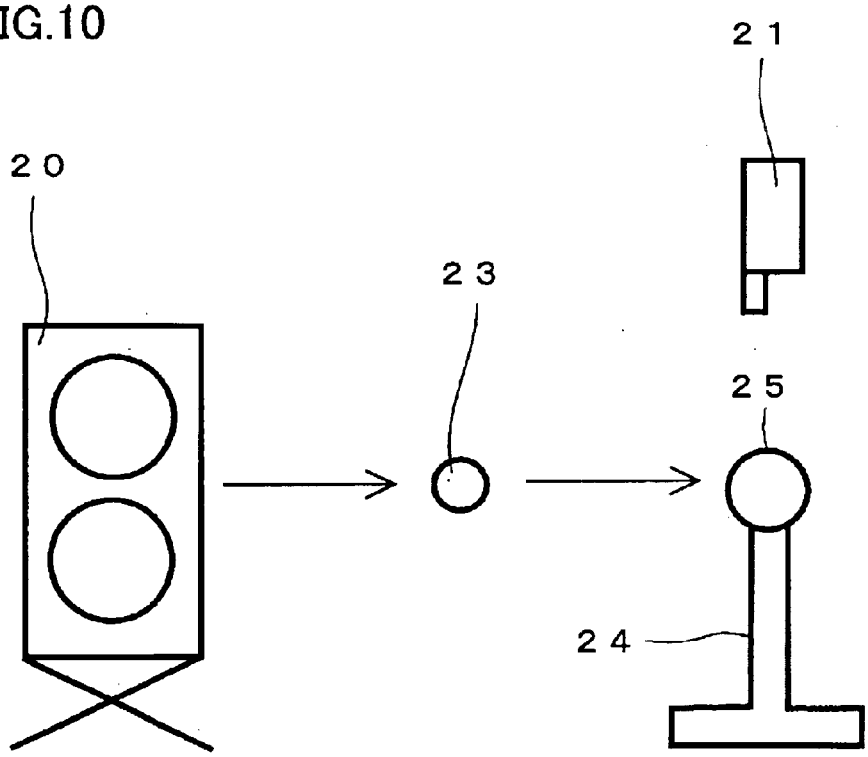
FIG. 10 is a schematic view of an experiment apparatus used for a rebound experiment of a bat.

Next, using an experiment apparatus as shown in FIG. 10, a rebound experiment of the bat was conducted.

As shown in FIG. 10, the experiment apparatus included a pitching machine 20, a high-speed video camera 21, an image analyzer (not shown) and a bat stand 24.

In the experiment, ball 23 was fed from pitching machine 20 to impact a bat 25 mounted on bat stand 24. High-speed video camera 21 filmed the impact from directly above. Then, restitution coefficient was calculated from the speed of ball 23 before and after the impact and the speed of bat 25. Note that restitution coefficient e was calculated with Equation 2.

$$e=-\{V\,BL\ (\mathrm{OUT})-(V\,BT\ (\mathrm{PAL})+a\cdot V\,BT\ (\mathrm{ROT}))\}/V\,BL\ (\mathrm{IN}) \quad [\text{Equation 2}]$$

e: restitution coefficient

V BL (OUT): velocity of gravity center of the ball after impact (m/s)

V BT (PAL): translation speed of gravity center of the bat after impact (m/s)

a: distance from gravity center of the bat to a ball-hitting position (more positive on the side of grip portion)

V BT (ROT): rotational angular velocity around gravity center of the bat after impact (rad/s)

V BL (IN): velocity of gravity center of the ball before impact (m/s)

Using the experiment apparatus shown in FIG. 10, restitution coefficient was found for the bat according to the present invention shown in FIGS. 1 and 2. For the rebound experiment, a conventional rubber-baseball bat made of metal and a rubber-baseball bat made of fiber-reinforced plastic, of the present invention shown in FIGS. 1 and 2, were used, of which specifications are shown in Table 2. Here, the elastic body of the bat of the present invention is of a polyurethane foam, having JIS C hardness of 43, specific gravity of 0.35 and elasticity modulus (tensile stress in 300% elongation) of 1.23 MPa. The elastic body integrally coats the depression of the ball-hitting portion to a thickness of 20 mm.

TABLE 2

| Bat | Total Length (mm) | Mass (g) | Center of Gravity (mm) | Moment of Inertia (kg · cm$^2$) |
|---|---|---|---|---|
| Present Invention | 840 | 721 | 526 | 1754 |
| Conventional Example | 837 | 724 | 518 | 1774 |

Center of gravity is given as the length from a grip end.
Moment of inertia is a value measured at 11 cm away from the grip end.

An experiment result, in which a rubber baseball impacts the ball-hitting portion of the bat at 130 km/h, is shown in Table 3.

TABLE 3

| Bat | Restitution Coefficient |
|---|---|
| Present Invention | 0.532 |
| Conventional Example | 0.485 |

As can be seen from the result in Table 3, the bat of the present invention has a restitution coefficient approximately 10% higher. Therefore, the bat of the present invention can carry the ball farther than the conventional one.

In addition, using the experiment apparatus shown in FIG. 10, restitution coefficient was found for the bat according to the present invention shown in FIGS. 5 and 6. For the rebound experiment, a conventional rubber-baseball bat made of metal and a rubber-baseball bat made of fiber-reinforced plastic, of the present invention shown in FIGS. 5 and 6, were used, of which specifications are shown in Table 4.

Here, distance T, which is a depth of end portion region 15 in depression 2 (see FIG. 5) of the bat according to the present invention used in the experiment, was set to 4.0 mm, width L of end portion region 15 was set to 15.0 mm, and inclination angle of the surface of end portion region 15 relative to central axis 6 (see FIG. 7) of bat 1 (see FIG. 5) was set to 0° (the surface of end portion region 15 is generally parallel to central axis 6).

The elastic body of the bat according to the present invention is of a polyurethane foam, having JIS C hardness of 43, specific gravity of 0.35 and elasticity modulus (tensile stress is 300% elongation) of 1.23 MPa. The elastic body integrally coats the center portion of the depression of the ball-hitting portion to a thickness of 20 mm. In addition, on the outermost layer of the polyurethane foam as elastic body 3 (see FIG. 5), a thermoplastic polyurethane tube is integrally formed. Here, the thermoplastic polyurethane tube is provided as a sheet 5 (see FIG. 5) with a thickness of 0.3 mm, obtained by fusing and adhering a sheet having JIS A hardness of 91 and tensile strength of 474 kg/cm$^2$.

TABLE 4

| Bat | Total Length (mm) | Mass (g) | Center of Gravity (mm) | Moment of Inertia (kg · cm$^2$) |
|---|---|---|---|---|
| Present Invention | 840 | 698 | 515 | 1637 |
| Conventional Example | 843 | 704 | 509 | 1627 |

An experiment result, in which a rubber baseball impacts the ball-hitting portion of the bat at 130 km/h similarly to the example shown in FIGS. 1 and 2, is shown in Table 5.

TABLE 5

| Bat | Restitution Coefficient |
|---|---|
| Present Invention | 0.524 |
| Conventional Example | 0.490 |

As can be seen from the result in Table 5, the bat of the present invention has a restitution coefficient approximately 7% higher. Therefore, the bat of the present invention can carry the ball farther than the conventional one.

Thus, the bat according to the present invention shown in FIGS. 1 and 2 or FIGS. 5 and 6 has a restitution coefficient higher than the conventional one, probably because of the following reasons. In the conventional bat, when hitting the ball, a ball-hitting surface will flexure and the ball considerably deforms. Then, the ball is carried while the ball-hitting surface and the ball restitute. On the other hand, in a bat according to the present invention, the thermoplastic polyurethane tube with a thickness of 0.3 mm and the elastic body (or elastic body 3, see FIG. 1) are initially compressed, and the impact energy in ball-hitting is converted to compression energy. As the ball is compressed and deforms thereafter, the extent of deformation of the ball in hitting will be smaller. As a result, energy loss due to ball deformation is lowered, and restoring force of the elastic body is added. Thus, rebound property is improved.

In addition, it goes without saying that the thermoplastic polyurethane tube integrally formed on the outermost layer of the elastic body functions without impairing the property of the elastic body encapsulated inside, and has good durability.

In the following, examples of a rubber-baseball bat according to the present invention will be described with reference to the drawings.

EXAMPLE 1

In order to verify the effect of the bat according to the present invention shown in FIGS. 1 and 2, an actual hitting test was conducted.

A rubber-baseball bat 1 used in the test as an example of the bat according to the present invention shown in FIGS. 1 and 2, was hollow and made of fiber-reinforced plastic. In the bat, a tip portion 10, a ball-hitting portion 11 having a depression 2, a tapered portion 12 and an outer shell of a grip portion 13 (a bat base member 7) were formed with internal pressure molding. A grip end 4 separately formed with a synthetic resin was inserted and adhered to the end of grip portion 13. After sandblasting depression 2 of ball-hitting portion 11, the bat was cast molded, using a mold designed to integrally coat depression 2 with elastic body 3. Here, for elastic body 3, a polyurethane foam having JIS C hardness of 43, specific gravity of 0.35 and elasticity modulus (tensile stress in 300% elongation) of 1.23 MPa was used.

Outer diameter of ball-hitting portion 11 was 70 mm, and outer diameter of ball-hitting center portion 11*a* extending from a position 40 mm away to a position 260 mm away from a bat tip end was 30 mm. An outer diameter from an end 11*b* of a tip portion side of ball-hitting center portion 11*a* to the boundary of tip portion 10 and an outer diameter from an end 11*c* of a tapered portion side of ball-hitting center portion 11*a* to the boundary of tapered portion 12 were gradually increased.

An actual hitting test was conducted, using rubber-baseball bat 1 according to the present invention as described above and a conventional rubber-baseball bat made of metal. A result is shown in Table 6.

TABLE 6

| Bat | Hit Distance (m) |
|---|---|
| Present Invention | 94.2 |
| Conventional Example | 86.4 |

The result of the above actual hitting test is the average of five amateur baseball club members. As were predicted through the results of the rebound experiment, the bat according to the present invention could carry the ball farther than the conventional one.

EXAMPLE 2

In order to verify the effect of the bat according to the present invention shown in FIGS. 5 and 6, an actual hitting test, similar to that in Example 1, was conducted.

A rubber-baseball bat 1 shown in FIGS. 5 and 6 basically has the same structure with the bat in Example 1. Bat 1 was hollow and made of fiber-reinforced plastic. In the bat, a tip portion 10, a ball-hitting portion 11 having a depression 2, a tapered portion 12 and an outer shell of a grip portion 13 were formed with internal pressure molding. A grip end 4 separately formed with a synthetic resin was inserted and adhered to the end of grip portion 13. In depression 2 formed in ball-hitting portion 11, an end portion region 15 was formed in the end portion thereof, as shown in FIG. 5. After sandblasting depression 2 of ball-hitting portion 11, the bat was cast molded, using a mold designed to integrally coat depression 2 with elastic body 3 and a tube as a sheet 5 obtained by fusing and adhering a thermoplastic polyurethane sheet of a thickness of 0.3 mm on the outermost layer. Here, for elastic body 3, a polyurethane foam having JIS C hardness of 43, specific gravity of 0.35 and elasticity modulus (tensile stress in 300% elongation) of 1.23 MPa was used, as in the bat in Example 1. In addition, for sheet 5 formed on the surface of elastic body 3, a tube obtained by fusing and adhering a thermoplastic polyurethane sheet of a thickness of 0.3 mm was used. The tube has JIS A hardness of 91 and tensile strength of 474 kg/cm$^2$.

An outer diameter of ball-hitting portion 11 was 70 mm, and an outer diameter of ball-hitting center portion 11*a* extending from a position 40 mm away to a position 260 mm away from a bat tip end was 30 mm. As shown in FIG. 7, sidewall 26 connecting end portion regions 15 positioned at both ends of depression 2 with the bottom wall in the center portion of depression 2 was inclined relative to central axis 6 of bat 1 (see FIG. 5). (As shown in FIG. 5, the outer diameter from an end 11*b* of a tip portion side of ball-hitting center portion 11*a* to the boundary of end portion region 15 positioned on tip portion 10 side and the outer diameter from an end 11*c* of a tapered portion side of ball-hitting center portion 11*a* to the boundary of end portion region 15 positioned on tapered portion 12 side were gradually increased.)

An actual hitting test was conducted, using rubber-baseball bat 1 in the above example and a conventional rubber-baseball bat made of metal. A result is shown in Table 7.

TABLE 7

| Bat | Hit Distance (m) |
|---|---|
| Present Invention | 92.8 |
| Conventional Example | 87.3 |

The result of the above actual hitting test is the average of five amateur baseball club members. As were predicted through the results of the rebound experiment, the bat according to the present invention could carry the ball farther than the conventional one.

Thus, in the present invention, the elastic body will be compressed and deform in hitting the ball, and energy loss due to the ball deformation will be suppressed. Further, the ball will be carried additionally with a restoring force of the elastic body. Consequently, the bat can be obtained, having rebound property superior to a conventional one and capable of carrying the ball farther.

In particular, even when hitting the soft ball such as a rubber baseball or a rubber softball, rebound property of the bat can be improved.

Moreover, the outermost layer of the elastic body is coated with a thermoplastic polyurethane sheet or tube of a thickness of 0.1 mm to 1.0 mm having a good abrasion-resistance. Thus, durability of the bat can be improved without impairing the property of the elastic body encapsulated inside. In addition, stepped portions (end portion regions) are provided in both the vicinities of a tip portion and a tapered portion. Thus, the elastic body and the thermoplastic polyurethane sheet will not separate even in the end portion, exhibiting good durability.

The above thermoplastic polyurethane sheet is desirably transparent or translucent. The sheet is printed on one surface, and is fused and adhered in a tube-like shape, with the printed surface facing inward. Thus, the print can be clearly viewed through the sheet, to enhance the appearance. Even after a prolonged use of bat, the print will not separate.

In games, a batter releases the bat when he starts running after hitting the ball. If the bat is coated with the elastic body up to the tip portion, the tip portion may soon be damaged by friction with the ground. Meanwhile, the bat according to the present invention can avoid such damage because the elastic body coats only the ball-hitting portion.

The bat according to the present invention can have the tip portion, the ball-hitting portion with the depression, the tapered portion and the grip portion formed with a hard material similar to the conventional one. Therefore, the bat can have rigidity comparable to the conventional one, and thus the bat is durable.

In addition, in a bat according to the present invention, as vibration in ball-hitting is absorbed by the elastic body, batter's hands will not be benumbed. Moreover, a time period during which the ball is in contact with the ball-hitting portion is extended because the elastic body deforms when hitting. Therefore, a feel that the ball is being on the bat can be obtained, and hitting feel will be improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baseball or softball bat including a ball-hitting portion comprising:

a depression in the ball-hitting portion integrally coated with an elastic body, the depression having a rounded corner in a bottom portion of the depression and a rounded corner in an upper portion of the depression, wherein the elastic body is formed of a single material; and wherein said elastic body is of a synthetic resin foam having JIS C hardness of 20 to 80, specific gravity of 0.25 to 0.70 and tensile stress of 1.0 MPa to 4.0 MPa in 300% elongation.

2. The baseball or softball bat according to claim 1, wherein said depression of said ball-hitting portion is formed with a ball-hitting center portion having an outer diameter smaller than that of the ball-hitting portion, and an outer diameter from an end of a tip portion side of said ball-hitting center portion to a boundary of said tip portion and an outer diameter from an end of a tapered portion side of said ball-hitting center portion to a boundary of said tapered portion are gradually increased.

3. The baseball or softball bat according to claim 1, wherein said elastic body does not extend into a tip portion of the bat, and said ball-hitting portion includes an outermost circumferential portion positioned in a region outside said depression and having a largest outer diameter, a small outer diameter portion provided as a wall surface of said depression and having an outer diameter smaller than that of said outermost circumferential portion, and a medium outer diameter portion provided as a wall surface of said depression, extending in a direction substantially the same with a central axis of said bat, positioned at an end portion of said depression and having an outer diameter larger than that of said small outer diameter portion and smaller than that of said outermost circumferential portion.

4. The baseball or softball bat according to claim 1, wherein said synthetic resin foam is a polyurethane foam.

5. The baseball or softball bat according to claim 1, wherein said elastic body is provided with a protection film formed on an outermost layer.

6. The baseball or softball bat according to claim 5, wherein said protection film includes at least one of a synthetic resin sheet and a synthetic resin tube.

7. The baseball or softball bat according to claim 5, wherein said protection film has a thickness of at least 0.1 mm and at most 1.0 mm, and said protection film includes a thermoplastic polyurethane.

8. The baseball or softball bat according to claim 1, wherein said depression is formed on an entire circumference of said ball-hitting portion.

9. The baseball or softball bat according to claim 1, the elastic body coating only the depression.

10. A bat base member including a tip portion, a ball-hitting portion and a central axis, comprising:

a depression formed in the ball-hitting portion, wherein the depression does not extend into the tip portion of the bat base member, and wherein the depression includes;

a center portion bottom wall;

a sidewall on both sides of the center portion bottom wall;

an end portion region on both sides of the center portion bottom wall; wherein the ball-hitting portion has a ball-hitting portion diameter;

the center portion bottom wall forms a center portion diameter that is less than the ball-hitting portion diameter;

the sidewalls on either side of the center portion bottom wall form a sidewall diameter that is greater than the center portion diameter, and less than the ball-hitting portion diameter; and the end portion regions on either side of the center portion bottom wall from an end portion region diameter that is greater than the sidewall diameter, and less than the ball-hitting portion diameter; wherein the center portion diameter is constant along the length of the center portion bottom wall;

the sidewall diameter increases from the center portion bottom wall to the end portion region; and the end portion region diameter is constant along the length of the end portion region.

11. The bat base member according to claim 10, wherein the depression is integrally coated with an elastic body.

12. The bat base member according to claim 11, wherein the elastic body is of a synthetic resin foam having JIS C hardness of 20 to 80, specific gravity of 0.25 to 0.70 and tensile stress of 1.0 MPa to 4.0 MPa in 300% elongation.

13. An elastic sleeve constituting a baseball or softball bat including a tip portion, a ball-hitting portion, a tapered portion and a grip portion, and fit into a depression formed in the ball-hitting portion, comprising:

a smallest inner diameter portion positioned in a center portion of said elastic sleeve and having a smallest inner diameter; and an enlarged inner diameter portion positioned at an end portion of said elastic sleeve, having an inner diameter larger than that of said smallest inner diameter portion and extending in a direction substantially the same with said elastic sleeve; and wherein said elastic sleeve is of a synthetic resin foam having JIS C hardness of 20 to 80, specific gravity of 0.25 to 0.70 and tensile stress of 1.0 MPa to 4.0 MPa in 300% elongation.

14. The elastic sleeve of claim 13 further comprising a wall surface constituting a connection portion of the smallest inner diameter portion with the enlarged inner diameter portion, and an upper portion and a lower portion of the wall surface having a rounded corner portion formed respectively.

15. A bat including a ball-hitting portion comprising:

a depression in the ball-hitting portion; and an elastic body coating the depression;

wherein the elastic body has JIS C hardness of 20 to 80, specific gravity of 0.25 to 0.70 and tensile stress of 1.0 MPa to 4.0 MPa in 300% elongation.

16. The bat according to claim 15, wherein side walls of the depression are non-perpendicular to a central axis of the bat.

17. The bat according to claim 15, wherein the elastic body coats only the depression, and is formed of a single material that fills the depression such that the elastic body lies flush with an outer periphery of the ball-hitting portion.

18. A baseball or softball bat including a ball-hitting portion comprising:

a depression in the ball-hitting portion, the depression including;

a center portion bottom wall;

a sidewall on both sides of the center portion bottom wall;

an end portion region on both sides of the center portion bottom wall; wherein the ball-hitting portion has a ball-hitting portion diameter;

the center portion bottom wall forms a center portion diameter that is less than the ball-hitting portion diameter;

the sidewalls on either side of the center portion bottom wall form a sidewall diameter that is greater than the center portion diameter, and less than the ball-hitting portion diameter; and the end portion regions on either side of the center portion bottom wall from an end portion region diameter that is greater than the sidewall diameter, and less than the ball-hitting portion diameter; wherein the center portion diameter is constant along the length of the center portion bottom wall;

the sidewall diameter increases from the center portion bottom wall to the end portion region; and the end portion region diameter is constant along the length of the end portion region.

19. The baseball or softball bat according to claim 18, wherein the depression is integrally coated with an elastic body that does not extend into a tip portion of the bat.

20. The baseball or softball bat according to claim 19, wherein the elastic body is formed of a single material.

* * * * *